US009134647B2

(12) United States Patent
Fukusaka et al.

(10) Patent No.: US 9,134,647 B2
(45) Date of Patent: Sep. 15, 2015

(54) IMAGE FORMING APPARATUS THAT CORRECTS DEVELOPING BIAS VOLTAGE

(71) Applicant: CANON KABUSHIKI KAISHA, Tokyo (JP)

(72) Inventors: Tetsuro Fukusaka, Abiko (JP); Hiroshi Saito, Kashiwa (JP); Shigemi Kumagai, Kashiwa (JP); Yoshitaka Yamazaki, Abiko (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/246,278

(22) Filed: Apr. 7, 2014

(65) Prior Publication Data

US 2014/0301749 A1 Oct. 9, 2014

(30) Foreign Application Priority Data

Apr. 8, 2013 (JP) ..... 2013-080383

(51) Int. Cl.
*G03G 15/06* (2006.01)
*G03G 15/00* (2006.01)

(52) U.S. Cl.
CPC ..... *G03G 15/065* (2013.01); *G03G 15/505* (2013.01)

(58) Field of Classification Search
CPC ..... G03G 15/1675; G03G 15/065; G03G 15/163; G03G 15/0121; G03G 2215/00632
See application file for complete search history.

(56) References Cited

U.S. PATENT DOCUMENTS

| | | | | |
|---|---|---|---|---|
| 5,235,515 | A * | 8/1993 | Ungpiyakul et al. | 700/125 |
| 2004/0057739 | A1* | 3/2004 | Shimura | 399/49 |
| 2013/0002790 | A1* | 1/2013 | Chino et al. | 347/224 |
| 2014/0301749 | A1 | 10/2014 | Fukusaka et al. | |

FOREIGN PATENT DOCUMENTS

| | | | |
|---|---|---|---|
| JP | 09-054487 | A | 2/1997 |
| JP | 2008-287075 | A | 11/2008 |

OTHER PUBLICATIONS

JP_2008287075_A_T Machine Translation.*
Notice of Allowance issued in U.S. Appl. No. 14/246,397 , dated Mar. 18, 2015.

* cited by examiner

*Primary Examiner* — Clayton E Laballe
*Assistant Examiner* — Victor Verbitsky
(74) *Attorney, Agent, or Firm* — Rossi, Kimms & McDowell LLP

(57) ABSTRACT

An image forming apparatus that reduces density irregularity caused by SD gap variation. A developing bias voltage for forming a developing electric field between a photosensitive drum and a developing sleeve is applied to the developing sleeve. A rotational period of the photosensitive drum is divided into a plurality of blocks, and current values are acquired for each block. An average value of the acquired current values for each block is stored until the photosensitive drum is rotated a predetermined number of times, for each of the predetermined number of times of rotation. A moving average value of the average values in each block is calculated, and a correction table for correcting the developing bias voltage to be applied in each block is created using the calculated moving average values, and the developing bias voltage is controlled based on the created correction table.

3 Claims, 14 Drawing Sheets

WAVEFORM OF DEVELOPING BIAS VOLTAGE

IMAGE FORMING APPARATUS THAT CORRECTS DEVELOPING BIAS VOLTAGE

BACKGROUND OF THE INVENTION

1. Field of the Invention

The present invention relates to an image forming apparatus that corrects developing bias voltage.

2. Description of the Related Art

Conventionally, as a developing method for copy machines and printers using an electrophotographic technique, there has been employed a method in which a developing bias voltage formed by superimposing an AC voltage component, such as a sine wave voltage, a rectangular wave voltage, or a triangular wave voltage, on a DC voltage component is applied to a developing roller which is generally implemented as a developing sleeve containing a magnetic material (developing magnet). The DC voltage component mainly contributes to density of a developed image, and the AC voltage component mainly contributes to contrast of a developed image.

In this developing method, off-centering of a spacer roller for holding a gap (SD gap) between the developing roller (developing sleeve) and a photosensitive drum sometimes causes periodic variation in the SD gap.

In this case, intensity of an electric field between the photosensitive drum and the developing roller periodically changes, which results in changes in density of a developed image.

As a solution to this problem, there has been disclosed a technique in which an AC component current of a developing bias is detected, and a DC component voltage of the same is sequentially changed according to the detected value of the AC component current, to thereby reduce density irregularity or variation caused by SD gap variation (see e.g. Japanese Patent Laid-Open Publication No. H09-54487).

Further, there has been disclosed a technique in which an image defect, such as density irregularity caused by SD gap variation, is reduced by performing FFT analysis of an AC current component of a detected developing bias to thereby extract a frequency component produced by off-centering of the photosensitive drum or the developing sleeve, calculating an opposite-phase component for offsetting the extracted frequency component, and superimposing an output of the opposite-phase component for offsetting the frequency component produced by off-centering, on the developing bias, at a timing shifted by a predetermined phase in synchronism with a drum rotation period during image formation (see e.g. Japanese Patent Laid-Open Publication No. 2008-287075).

However, in the image forming apparatus described in Japanese Patent Laid-Open Publication No. H09-54487, SD gap variation, as a cause of image density variation, is detected by the AC current component of the developing bias, and the DC voltage of the developing bias which changes image density is sequentially corrected, and hence image density variation can be corrected, but the AC current and the DC voltage of the developing bias have no direct correlation therebetween, and feedback control in this case does not form a feedback loop.

In other words, the feedback loop is not electrically closed, and hence if the amount of correction is increased, this increases a possibility of oscillation of the control, whereas if the amount of correction is reduced, this increases a possibility of an insufficient correction effect.

Further, although changes in the AC component current of the detected developing bias are sequentially corrected by correcting the DC voltage, the AC component current of the detected developing bias reflects not only variation caused by off-centering of the photosensitive drum or the developing sleeve but also variations caused by various factors. Therefore, this correction changes the DC voltage so as to correct even variations not required to be corrected, which can be a cause of unstable control.

Further, to perform FFT analysis of the AC current component of the detected developing bias to thereby extract the frequency component produced by off-centering of the photosensitive drum or the developing sleeve, as in the image forming apparatus disclosed in Japanese Patent Laid-Open Publication No. 2008-287075, a complicated FFT analysis circuit is required, which can be a factor increasing the costs.

SUMMARY OF THE INVENTION

The present invention provides an image forming apparatus that reduces density irregularity caused by SD gap variation.

The present invention provides an image forming apparatus comprising a photosensitive drum configured to be driven for rotation, a developing roller configured to carry toner for developing an electrostatic latent image formed on the photosensitive drum, the developing roller being disposed in a manner opposed to the photosensitive drum and driven for rotation, an application unit configured to apply a developing bias voltage for forming a developing electric field between the photosensitive drum and the developing roller, to the developing roller, formation of the developing electric field causing the electrostatic latent image to be developed with toner carried by the developing roller, a current value detection unit configured to detect a current value corresponding to an electrostatic capacitance between the photosensitive drum and the developing roller, a phase detection unit configured to detect a rotation phase of the photosensitive drum, an acquisition unit configured to acquire a current value detected by the current value detection unit for each of a plurality of blocks of a period of one rotation of the photosensitive drum in synchronism with a rotation phase detected by the phase detection unit during rotation of the photosensitive drum and the developing roller, a storage unit configured to store an average value of current values acquired by the acquisition unit for each of the plurality of blocks, for each of a predetermined number of times of rotation, until the photosensitive drum is rotated the predetermined number of times, a calculation unit configured to calculate a moving average value of ones, in each of the plurality of blocks, of the average values stored in the storage section, after the photosensitive drum is rotated the predetermined number of times, a creation unit configured to create a correction table for correcting the developing bias voltage to be applied by the application unit in each of the plurality of blocks, using the moving average value for each block, calculated by the calculation unit, and an image forming unit configured to control the developing bias voltage based on the correction table created by the creation unit.

According to the present invention, only change in rotation period of the photosensitive drum is extracted, and a correction value corresponding to an amount of the extracted change is fed back to the developing bias voltage. Therefore, it is possible to provide an image forming apparatus that reduces density irregularity caused by SD gap variation.

Further features of the present invention will become apparent from the following description of exemplary embodiments (with reference to the attached drawings).

BRIEF DESCRIPTION OF THE DRAWINGS

FIGS. 14A and 14B are diagrams formed by plotting values obtained by measuring brightness of an output image of entire-surface halftone having 10% of density in a sub scanning direction in synchronism with an output from a drum home position sensor HP, in which FIG. 14A is a diagram before correction of density irregularity of the image, and FIG. 14B is a diagram after correction of density irregularity of the image.

DESCRIPTION OF THE EMBODIMENTS

The present invention will now be described in detail below with reference to the accompanying drawings showing embodiments thereof.

Figure 1:
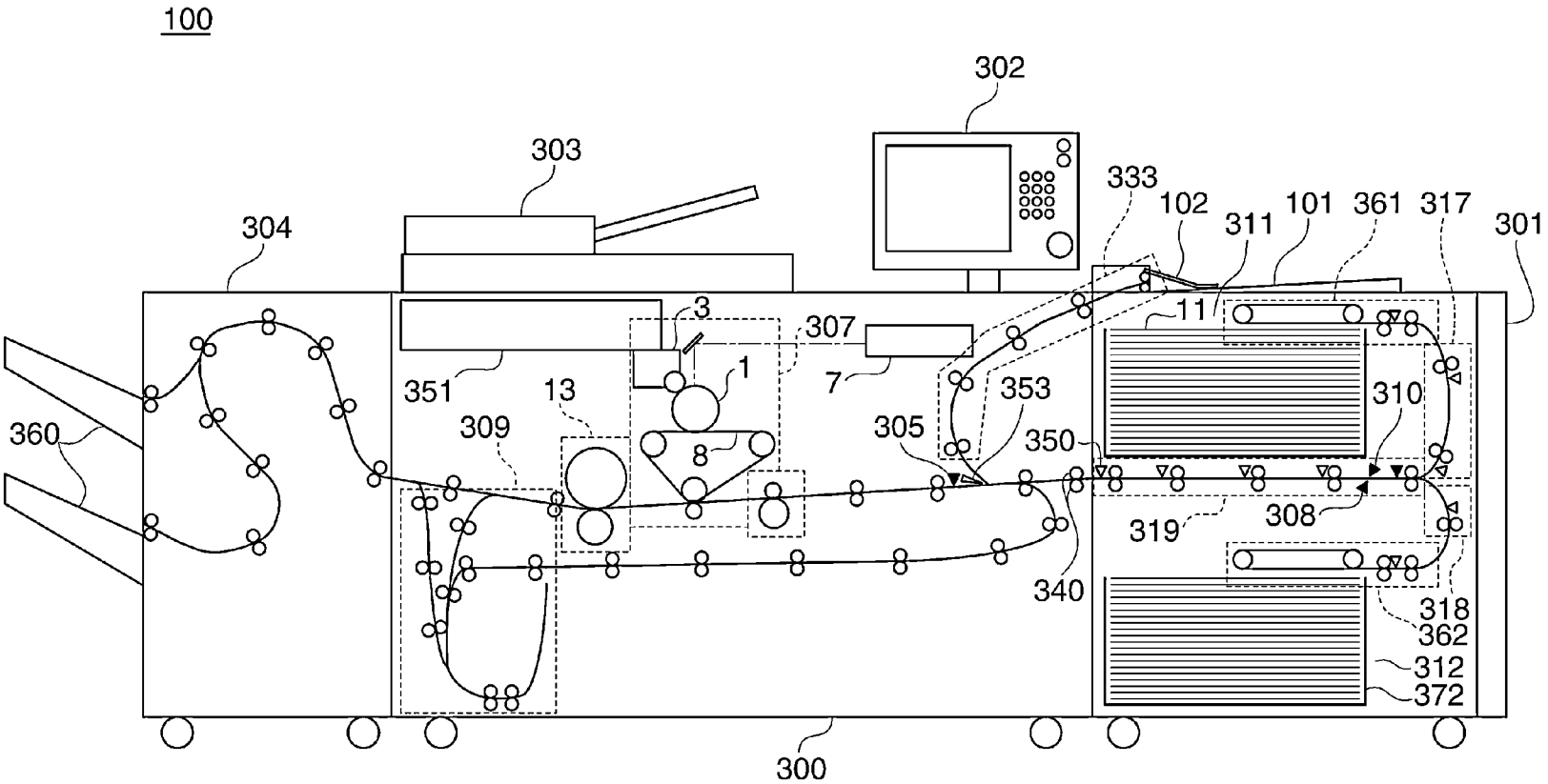
FIG. 1 is a schematic diagram of an image forming system including an image forming apparatus according to an embodiment of the present invention.

FIG. 1 is a schematic diagram of an image forming system 100 including an image forming apparatus 300 according to an embodiment of the present invention.

Referring to FIG. 1, the image forming system 100 comprises a sheet feeder 301, the image forming apparatus 300, a console section 302, a reader scanner 303, and a post-processing apparatus 304.

The image forming system 100 executes feeding and conveying of a sheet, image formation, and post processing, based on sheet processing settings set by a user from the console section 302 or from an external host PC, not shown, and image information sent from the reader scanner 303 or from the external host PC, and then outputs a print. A series of processing operations performed by the image forming apparatus will be described hereafter. Further, in the following description, "forming an image" is sometimes referred to simply as "printing".

The sheet feeder 301 comprises upper and lower sheet feeding sections 311 and 312 that store sheets stacked as sheet bundles in storages 11 and 372 provided therein, and feeds sheets from the sheet feeding sections 311 and 312, as needed.

The top of the sheet feeder 301 is provided with an escape tray 101 for discharging multi-fed sheets. A full stack detector 102 is provided for detecting a state of the escape tray 101 fully stacked with discharged sheets.

An operation for feeding a sheet is performed by sheet suction-conveyance sections 361 and 362. In the present embodiment, a plurality of fans, not shown, are arranged on the sheet suction-conveyance sections 361 and 362 for air feeding control.

In a sheet feeding operation, the fans are controlled such that air is blown in between sheets in each of the storages 11 and 372 from the upstream side in a conveying direction. When the sheets are separated, each sheet is fed and conveyed in a state sucked to an endless belt by a sheet suction fan arranged within the endless belt.

In the upper sheet feeding section 311, sheet conveyance is continued by an upper conveying section 317, whereas in the lower sheet feeding section 312, sheet conveyance is continued by a lower conveying section 318. In both of the cases, each sheet continues to be conveyed to a combined conveying section 319 where the upper conveying section 317 and the lower conveying sections 318 joins.

Although not shown, each conveying section includes a stepper motor for conveying a sheet. The stepper motor provided in each conveying section is controlled by a conveyance controller, and torque of the stepper motor is mechanically transmitted to rotate conveying rollers of each conveying section to thereby convey the sheet.

Further, the combined conveying section 319 is provided with a light emitting device 308 and a light receiving device 310 in a manner opposed to each other across a conveying path, which form a multi-feed detection sensor.

The sheet feeder 301 sequentially feeds and conveys sheets from each storage according to sheet request information received from the image forming apparatus 300. The sheet feeder 301 conveys each sheet to a conveyance sensor 350 disposed at a location where the sheet is passed to the image forming apparatus 300, and notifies the image forming apparatus of completion of preparation for passing the sheet from the sheet feeder 301 to the image forming apparatus 300.

Upon receipt of the notification of preparation completion from the sheet feeder 301, the image forming apparatus 300 sends a delivery request to the sheet feeder 301. The sheet feeder 301 sequentially conveys the sheets one by one to the image forming apparatus in response to each delivery request.

When a leading edge of a sheet conveyed out of the sheet feeder 301 reaches a nip of a conveying roller pair 340 as the most upstream pair of the image forming apparatus 300, the sheet is drawn out of the sheet feeder 301 into the image forming apparatus 300 by the conveying roller pair 340.

The sheet feeder 301 terminates the feeding operation when conveyance of the number of sheets requested by the image forming apparatus 300 is completed. Then, the sheet feeder 301 terminates its operation after the sheets have been drawn out by the image forming apparatus 300, and then enters the standby state.

The image forming apparatus 300 sends the delivery request to the above-described sheet feeder 301, and draws the sheets out of the sheet feeder 301 one by one to sequentially perform image formation thereon.

The console section 302 for allowing a user to configure operation settings of the image forming apparatus, and the reader scanner 303 for reading an original image are arranged on the top of the image forming apparatus 300.

After receiving each sheet from the sheet feeder 301 connected to the image forming apparatus 300, the image forming apparatus 300 causes conveying sections to convey the sheet. A flapper 353 selects a conveying path leading to the escape tray 101 when multi-feed of sheets is detected by the light emitting device 308 and the light receiving device 310, and a conveying path leading to an image forming section 307 when multi-feed of sheets is not detected.

If multi-feed of sheets is detected, the sheets are discharged to the escape tray 101. If multi-feed of sheets is not detected, an image forming operation based on received image data is performed by the image forming section 307 with reference to a time point that the sheet is detected by an image reference sensor 305.

Although in the present embodiment, the image forming apparatus 300 is provided with an escape conveying section 333 for discharging a sheet to the escape tray 101, the escape conveying section 333 may be provided in the sheet feeder 301.

Then, a semiconductor laser of a laser scanner 7 is lighted on, light amount control is performed, and a scanner motor which drives a polygon mirror, not shown, for rotation is controlled to thereby form a latent image on a photosensitive drum 1 as a photosensitive member of the present invention, with a laser beam based on the image data.

A developing device 3 to which toner is supplied from a toner bottle 351 develops the latent image on the photosensitive drum 1 with toner, and the developed toner image is primarily transferred to an intermediate transfer belt 8 from the photosensitive drum 1.

The toner image transferred to the intermediate transfer belt 8 is secondarily transferred to a sheet, whereby the toner image is formed on the sheet. The sheet which has been subjected to secondary transfer is conveyed to a fixing section 13, and the fixing section 13 applies heat and pressure to the sheet to thereby fuse and fix the toner on the sheet.

The sheet having the toner fixed thereon is conveyed to an inversion conveying section 309 when it is necessary to invert the sheet, such as when the sheet is to be sequentially printed on a reverse side thereof, whereas if printing on the sheet is completed, conveyance of the sheet is continued to thereby convey the sheet to a discharge device disposed at a location downstream of the fixing section 13.

The post-processing apparatus 304 connected to the downstream side of the image forming apparatus 300 executes desired post processing, such as folding, stapling, and punching, set by the user from the console section 302, on sheets on which image formation has been performed, and sequentially outputs printed matter thus formed onto a discharge tray 360.

Figure 2:
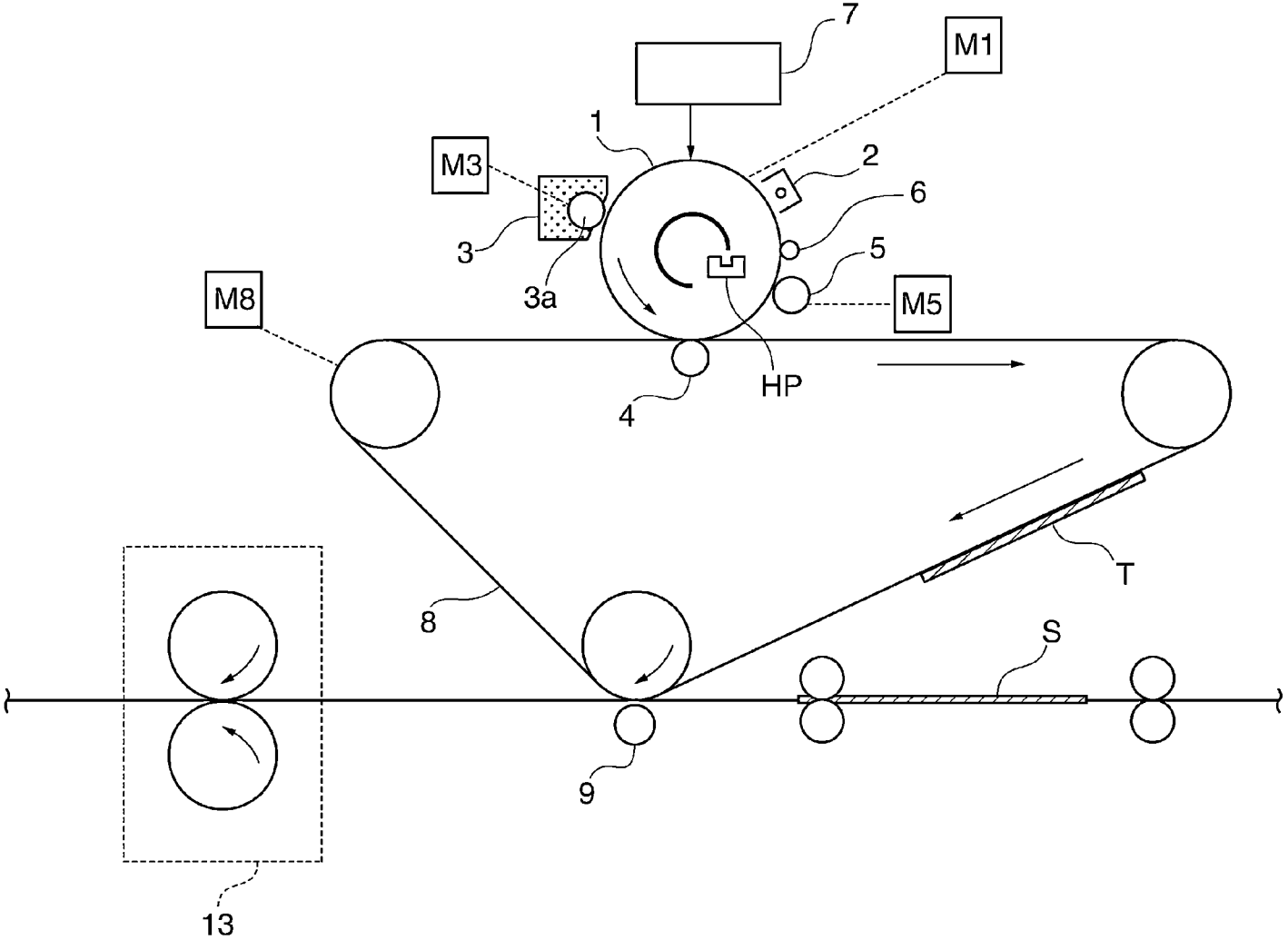
FIG. 2 is a schematic diagram of an image forming section appearing in FIG. 1.

FIG. 2 is a schematic diagram of the image forming section 307 appearing in FIG. 1.

Referring to FIG. 2, the image forming apparatus 300 has a structure in which a primary electrostatic charger 2, the developing device 3, a primary transfer roller 4, a cleaner 5, and a pre-exposure section 6 are arranged around the photosensitive drum 1.

The developing device 3 includes a developing sleeve 3*a*, as a developing roller of the present invention, which is disposed in a manner opposed to the photosensitive drum 1, and carries developer (toner, or toner and magnetic carrier) for developing an electrostatic latent image carried on the photosensitive drum 1. The rotational axis of the photosensitive drum 1 and the rotational axis of the developing sleeve 3*a* are fixed by a casing of the apparatus and a spacer, whereby a predetermined distance is secured therebetween.

The electrostatic latent image formed on the rotating photosensitive drum 1 by the laser scanner 7 is developed by the developing device 3 into a toner image. The photosensitive drum 1 is driven for rotation by a drum motor M1, and a drum home position sensor HP detects rotation of the photosensitive drum 1.

The drum home position sensor HP corresponds to a phase detection unit configured to detect a rotation phase of the photosensitive drum 1, and generates a detection signal whenever the photosensitive drum 1 performs one rotation to thereby enable detection of a rotation phase of the photosensitive drum 1. Note that the drum home position refers to a home position of the photosensitive drum 1.

The developing sleeve 3*a* of the developing device 3 is driven for rotation by a developing sleeve motor M3. The developed toner image is transferred onto the intermediate transfer belt 8 by the primary transfer roller 4, and is sent to a secondary transfer section 9.

The intermediate transfer belt 8 is driven by an ITB (intermediate transfer belt) motor M8. The secondary transfer section 9 transfers the toner image T on the intermediate transfer belt 8 onto a conveyed sheet S. A cleaner motor M5 drives the cleaner 5.

Figure 3:
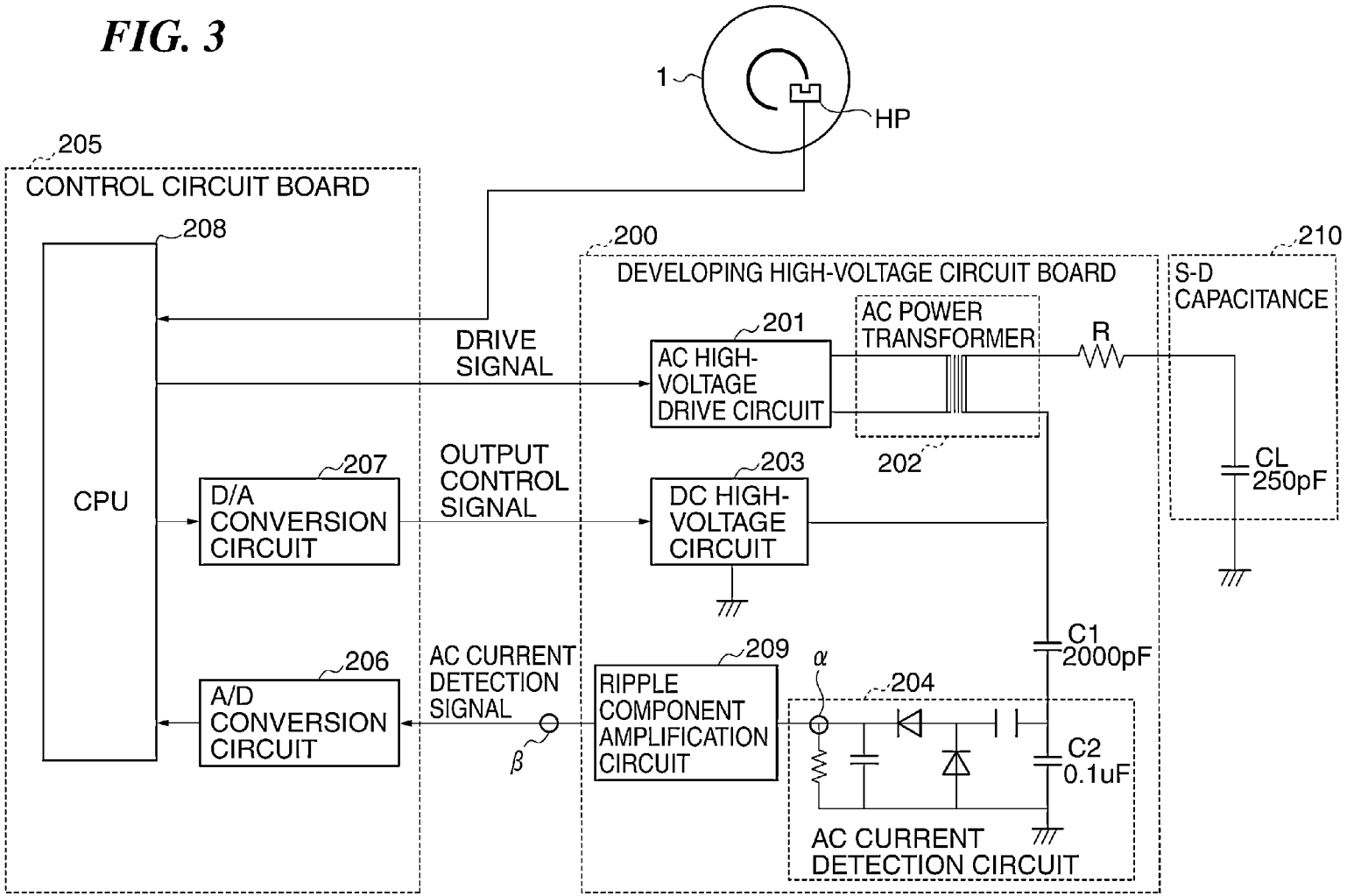
FIG. 3 is a schematic diagram of a developing high-voltage circuit board and a control circuit board of the image forming apparatus appearing in FIG. 1.

FIG. 3 is a schematic diagram of a developing high-voltage circuit board 200 and a control circuit board 205 of the image forming apparatus 300 appearing in FIG. 1.

Referring to FIG. 3, the image forming apparatus 300 is equipped with the developing high-voltage circuit board 200 and the control circuit board 205.

Mounted on the developing high-voltage circuit board 200 are an AC high-voltage drive circuit 201, an AC power transformer 202, a DC high-voltage circuit 203, an AC current detection circuit 204, a ripple component amplification circuit 209, a capacitor C1, a capacitor C2, and an output register R.

The AC high-voltage drive circuit 201, the DC high-voltage circuit 203, and the AC transformer correspond to an application unit configured to apply a developing bias voltage to the developing sleeve 3*a*, so as to form a developing electric field between the photosensitive drum 1 and the developing sleeve 3*a*.

Mounted on the control circuit board 205 are an analog-to-digital converter circuit 206, a digital-to-analog converter circuit 207, and a CPU 208.

On the developing high-voltage circuit board 200, the AC high-voltage drive circuit 201 generates a developing AC bias voltage, and the AC transformer 202 superimposes a developing DC bias voltage generated by the DC high-voltage circuit 203 on the generated developing AC bias voltage, whereby the resulting developing bias voltage is supplied to the developing sleeve 3*a*. That is, the developing bias voltage formed by superimposing the developing AC bias voltage and the developing DC bias voltage is applied to an S-D capacitance 210 appearing in FIG. 3. Note that α and β in FIG. 3 will be referred to hereinafter.

Figure 4:
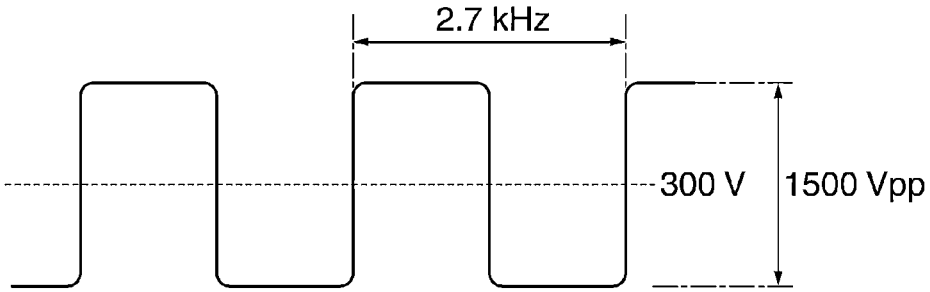
FIG. 4 is a diagram showing a waveform of a developing bias voltage formed by superimposing a developing AC bias voltage and a developing DC bias voltage.

FIG. 4 is a diagram showing a waveform of the developing bias voltage formed by superimposing the developing AC bias voltage and the developing DC bias voltage.

As shown in FIG. 4, in the image forming apparatus 300 according to the present embodiment, the developing bias voltage is formed by superimposing the developing DC bias voltage (Vdc) of 300V on the developing AC bias voltage having a rectangular wave of a frequency of 2.7 kHz and an amplitude of 1500V. The developing bias voltage thus formed by superimposing the AC voltage and the DC voltage is applied.

An SD gap formed by the developing sleeve 3*a* and the photosensitive drum 1 as an electric equivalent circuit provides an electrostatic capacitance, and is represented by an S-D capacitance CL in FIG. 3. In the image forming apparatus 300 according to the present embodiment, the S-D capacitance CL is approximately 250 pF.

Referring again to FIG. 3, an AC current component of the developing bias supplied from the AC power transformer 202 to the photosensitive drum 1 via the developing sleeve 3*a* is detected by the AC current detection circuit 204. The AC current detection circuit 204 thus detects a current value of an AC component caused to flow by the developing bias voltage applied by the AC high-voltage drive circuit 201 and the DC high-voltage circuit 203. The AC current detection circuit 204 corresponds to a current value detection unit configured to detect a current value which is proportional to the electrostatic capacitance between the photosensitive drum 1 and the developing sleeve 3*a*.

Figure 5:
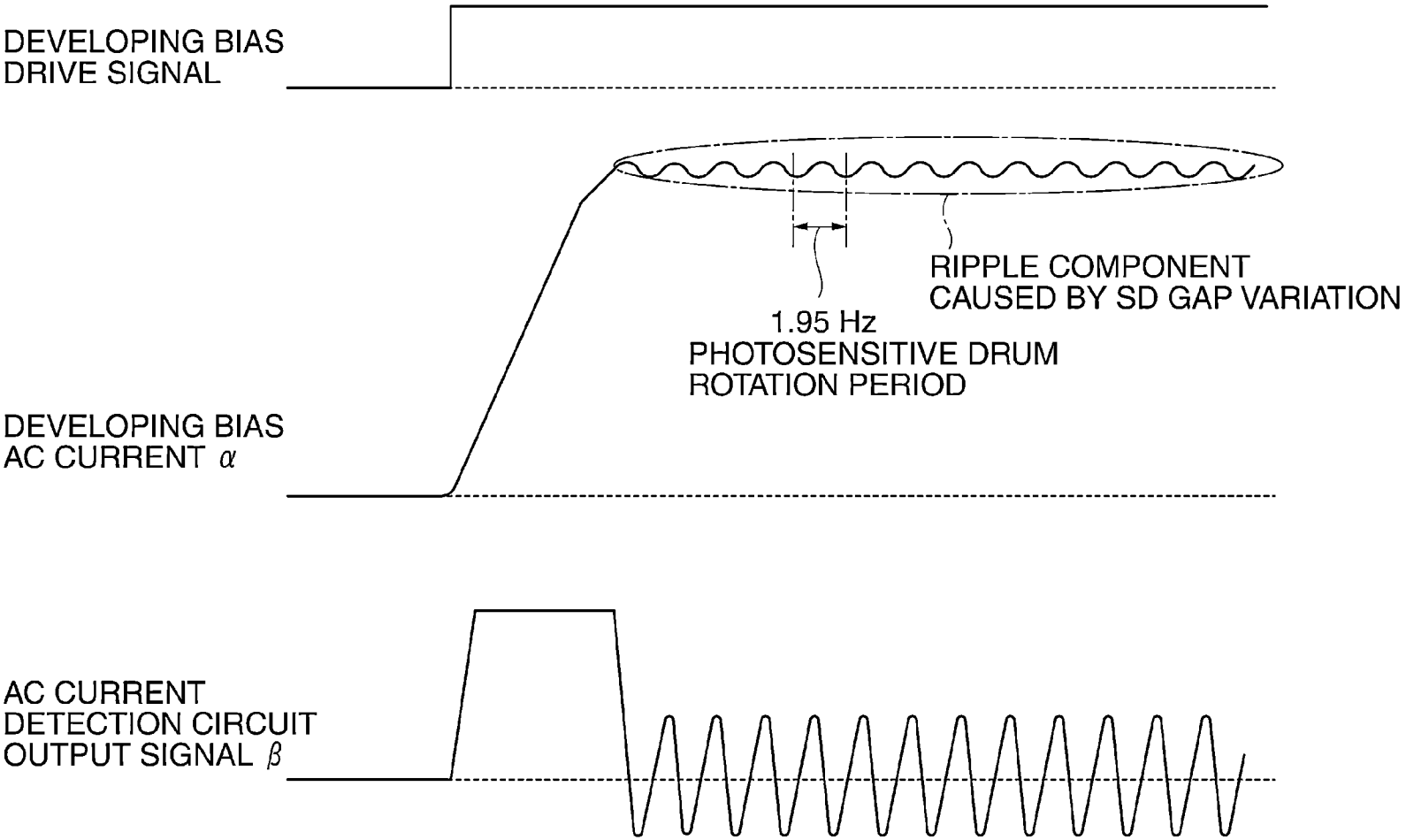
FIG. 5 is a timing diagram of a developing bias drive signal, a developing bias AC current, and a signal output from an AC current detection circuit, at the time of application of a developing bias to a developing sleeve appearing in FIG. 2.

FIG. 5 is a timing diagram of a developing bias drive signal, a developing bias AC current, and a signal output from the AC current detection circuit 204, at the time of application of the developing bias to the developing sleeve 3*a* appearing in FIG. 2.

When the developing bias drive signal is turned on, the developing bias is applied to the developing sleeve 3*a*, whereby the AC current is supplied to the S-D capacitance CL. This current is output from the AC current detection circuit 204 (α point in FIG. 3), and then is output from the ripple component amplification circuit 209 after only a ripple component of the AC current is amplified by the ripple component amplification circuit 209 (β point in FIG. 3). Further, as shown in FIG. 5, a period of the ripple component is 1.95 Hz which is the rotation period of the photosensitive drum 1.

The ripple component amplification circuit 209 clamps a voltage not lower than or not higher than a predetermined voltage according to a range of allowable input voltage of the analog-to-digital converter circuit 206, and outputs the clamped voltage to the analog-to-digital converter circuit 206.

When the SD gap changes, the electrostatic capacitance CL formed by the SD gap changes, and hence the change can be detected as a change in developing bias AC current.

Figure 6:
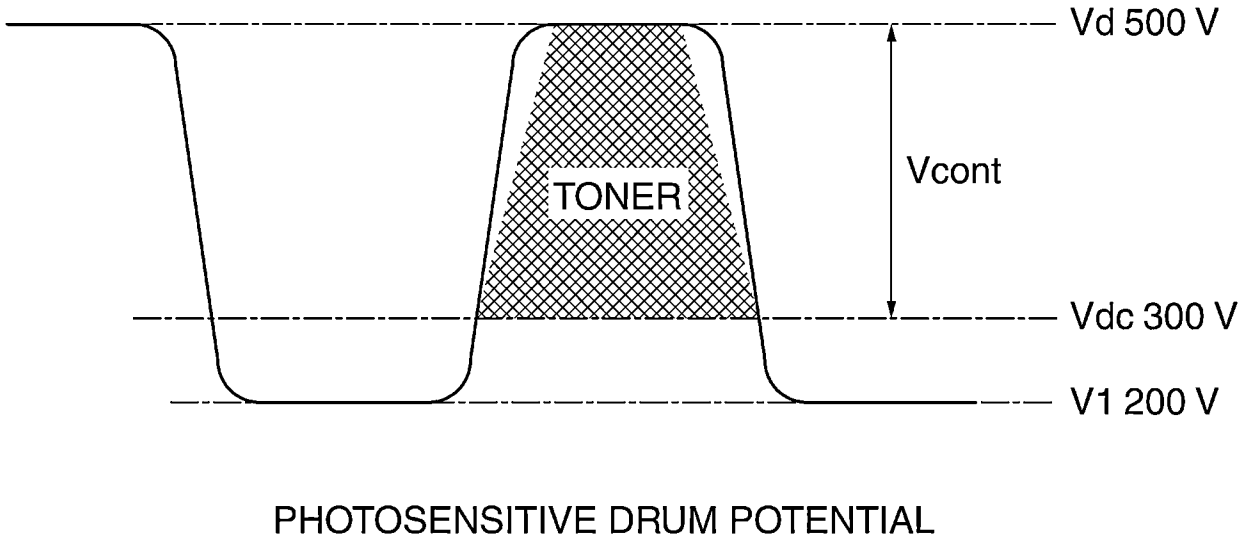
FIG. 6 is a diagram showing a relationship between a potential of a photosensitive drum appearing in FIG. 2 and the developing DC bias voltage.

FIG. 6 is a diagram showing a relationship between a potential of the photosensitive drum 1 appearing in FIG. 2 and the developing DC bias voltage Vdc.

In the image forming apparatus 300 according to the present embodiment, toner is negatively charged, and hence more amount of toner is developed as the potential of the photosensitive drum 1 is higher. In FIG. 6, Vd represents a charging potential (dark part potential) of the photosensitive drum 1, Vdc the developing DC bias voltage, and Vl a potential of an exposed part (bright part potential). As the difference, denoted by Vcont, between Vd and Vdc is larger, developability becomes higher.

On the other hand, if the SD gap is increased, developability becomes lower. At this time, the S-D electrostatic capacitance CL is reduced, so that the detected developing bias AC current is reduced. Therefore, by reducing Vdc to thereby secure Vcont, developability can be increased.

Inversely, if the SD gap is reduced, developability becomes higher. At this time, the S-D electrostatic capacitance CL is increased, so that the developing bias AC current is increased. Therefore, by increasing Vdc to thereby reduce Vcont, developability can be reduced.

In the control circuit board 205, the analog-to-digital converter circuit 206 converts an AC current detection signal output from the AC current detection circuit 204 from analog to digital, and transfers the converted signal to the CPU 208.

Figure 7A:
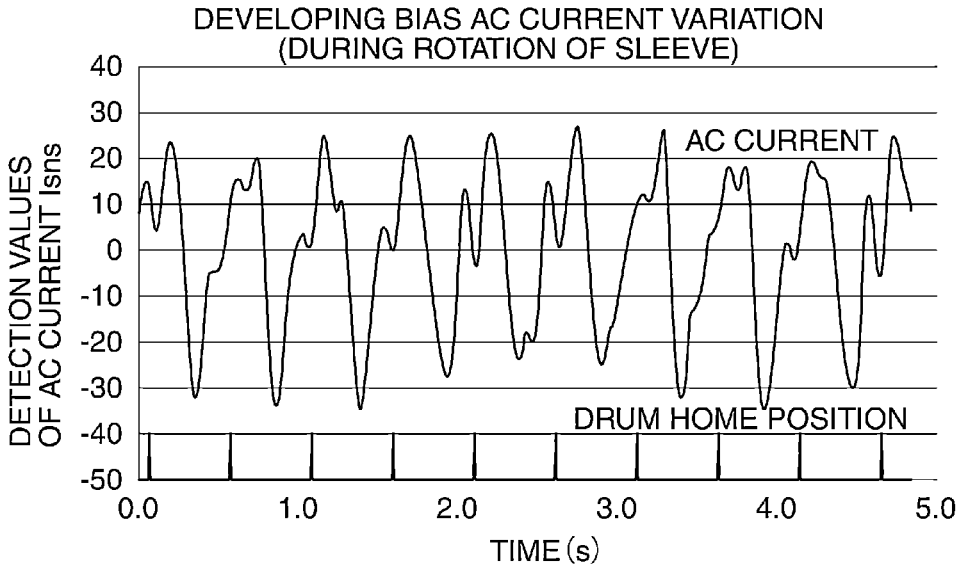
FIG. 7A is a diagram showing a waveform of variation in the developing bias AC current.
Figure 7B:
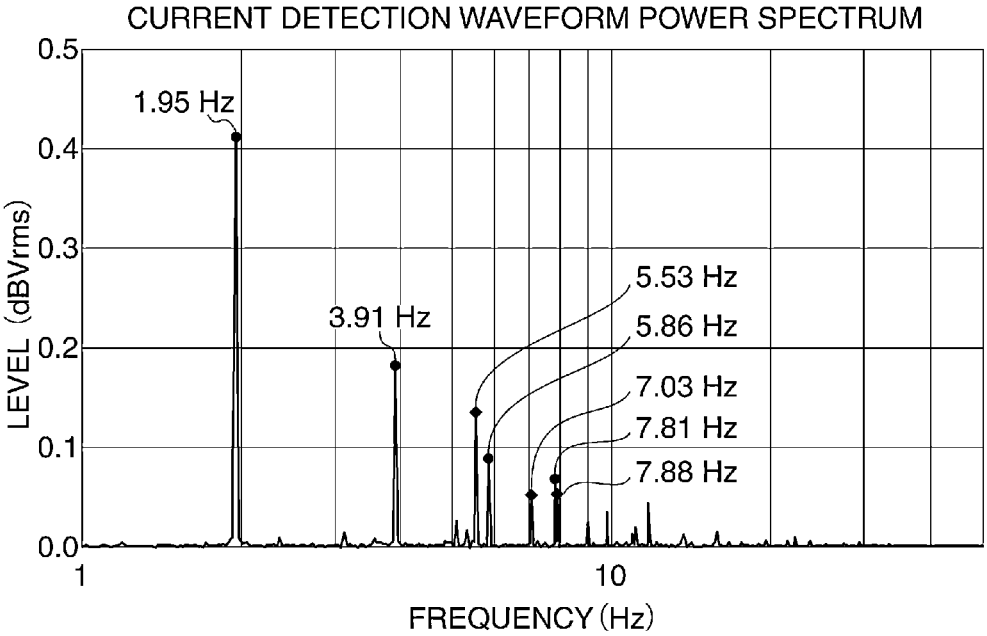
FIG. 7B is a diagram showing a result of FFT analysis of the waveform of variation in the developing bias AC current.

FIGS. 7A and 7B are diagrams showing a waveform of variation in the developing bias AC current and results of FFT (fast Fourier transform) analysis of the developing bias AC current.

FIG. 7A is a diagram showing a waveform of the developing bias AC current and the drum home position signal, in a case where all of the drive sections of the image forming system, such as the photosensitive drum 1, the developing sleeve 3*a*, and the intermediate transfer belt 8, are being rotated e.g. during normal printing.

In a graph shown in FIG. 7A, the horizontal axis represents time, and the vertical axis represents detection values of the developing bias AC current. FIG. 7A shows that the developing bias AC current varies at a rotation period of the photosensitive drum 1.

FIG. 7B is a diagram showing results of FFT analysis of the waveform of the developing bias AC current.

The frequency corresponding to the rotation period of the photosensitive drum 1 of the image forming apparatus 300 according to the present embodiment is 1.95 Hz, and with this as a base frequency, the graph indicates that frequencies of 3.91 Hz, 5.86 Hz, and 7.81 Hz, which are twice, three times, and four times the base frequency, are strongly detected.

A frequency 5.53 Hz, which is another detected frequency than the above-mentioned frequencies corresponding to the drum rotation period and integral multiples thereof, corresponds to a rotation period of the developing sleeve 3*a*, and frequencies 7.03 Hz and 7.88 Hz are those corresponding to rotation periods of components of a drive system, not shown, of the developing sleeve 3*a*. It is confirmed that the levels of these frequencies are not larger than ⅓ of those of the frequencies indicative of variation in the developing bias AC current caused by the rotation period of the photosensitive drum 1.

Figure 8A:
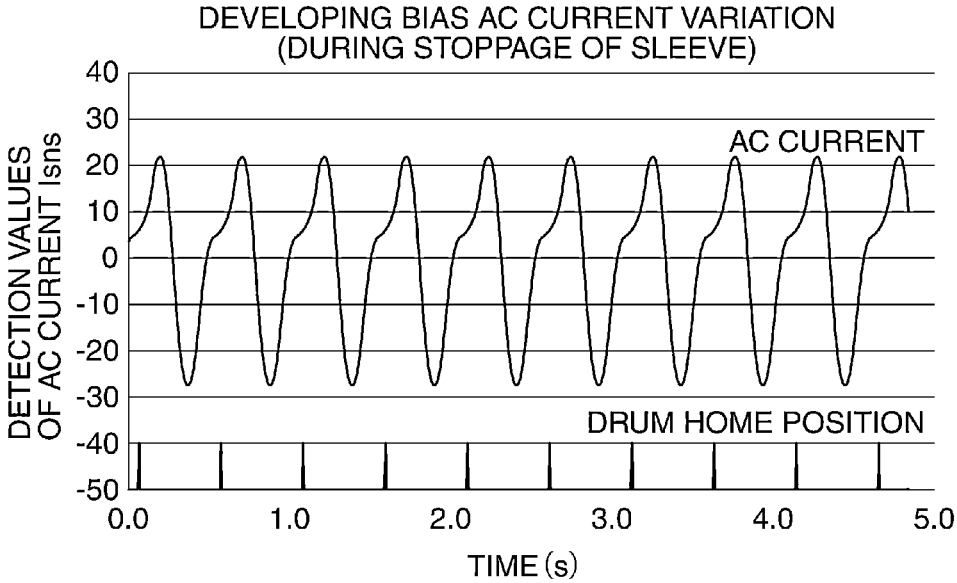
FIG. 8A is a diagram showing a waveform of an AC current and a drum home position signal in a rotation-stopped state of the developing sleeve that rotates during normal printing.

FIG. 8A is a diagram showing a waveform of the developing bias AC current and the drum home position signal in a rotation-stopped state of the developing sleeve 3*a* that rotates during normal printing.

There is no frequency components caused by the rotation periods of the developing sleeve 3*a* and the components of the drive system of the developing sleeve 3*a*, and hence most of changes are caused by the rotation period of the photosensitive drum 1, whereby the same waveform is repeated at the rotation period of the photosensitive drum 1.

Here, it is understood that most of changes in the developing bias AC current are caused by the rotation period of the photosensitive drum 1. Changes caused by the developing sleeve 3*a* are excluded, and hence an amplitude of changes is reduced by approximately 10 to 20%, compared with that shown FIG. 7A.

Figure 8B:
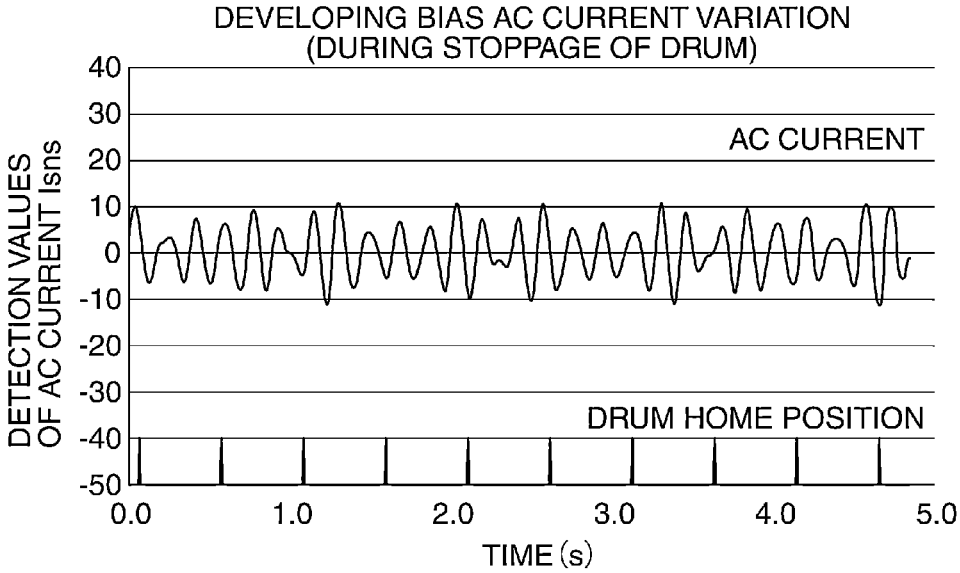
FIG. 8B is a diagram showing a waveform of the AC current and the drum home position signal in the rotation-stopped state of the photosensitive drum.

FIG. 8B is a diagram showing a waveform of the developing bias AC current and the drum home position signal in the rotation-stopped state of the photosensitive drum 1.

As is also understood from the power spectrum shown in FIG. 7B, in FIG. 8B, since most of changes in the developing bias AC current are caused by the photosensitive drum, the amplitude of changes is within approximately ¼ of that in the normal state. Further, as a matter of course, the changes are not related to the rotation period of the photosensitive drum 1, and it is understood that these frequency components cannot be corrected by controlling the rotation period of the photosensitive drum 1.

Figure 9:
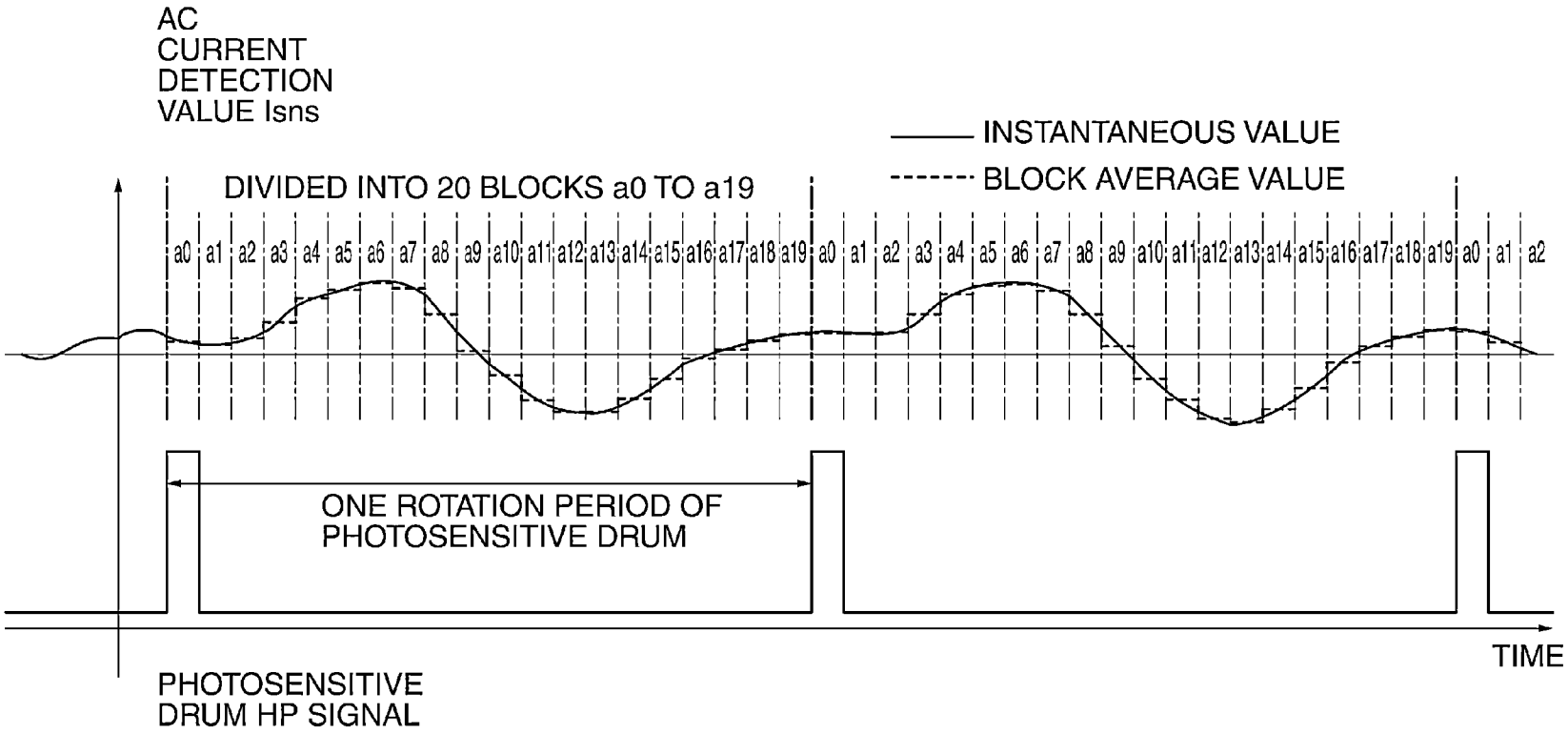
FIG. 9 is a diagram showing a detection value of a detection signal of the developing bias AC current in each of a plurality of blocks formed by dividing the rotation period of the photosensitive drum.

FIG. 9 is a diagram showing a detection value of a detection signal of the developing bias AC current in each of a plurality of time periods (hereinafter referred to as the blocks) formed by dividing the rotation period of the photosensitive drum 1.

Referring to FIG. 9, the horizontal axis represents time, and the vertical axis represents detection values of the developing bias AC current.

In FIG. 9, one rotation period of the photosensitive drum 1 is divided into 20 blocks of a0 to a19 with reference to a time point of output from the drum home position sensor HP, and instantaneous values and an average value of the instantaneous values of the developing bias AC current detection value in each block are indicated.

Figure 10A:
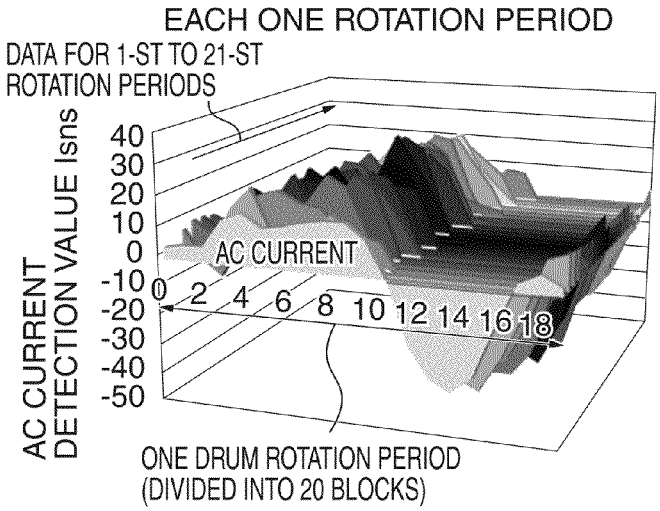
FIGS. 10A to 10C are diagrams useful in explaining moving average of averaged detection values of the developing bias AC current in the respective 20 blocks, calculated for each rotation period of the photosensitive drum 1 appearing in FIG. 2.
Figure 10B:
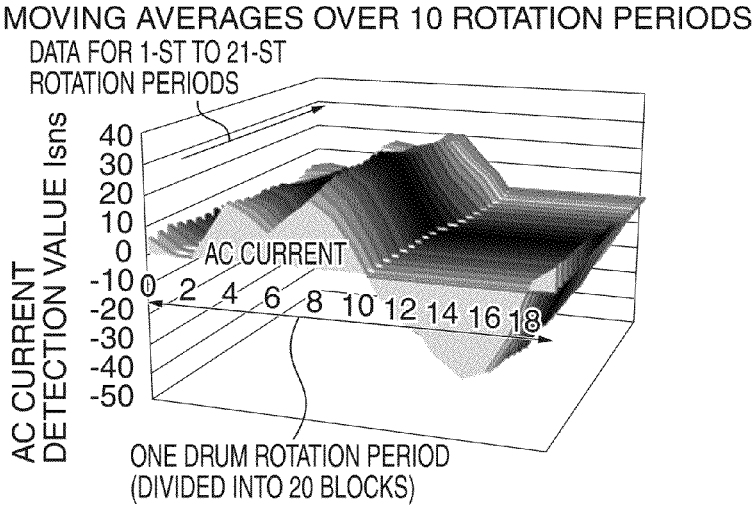
Figure 10C:
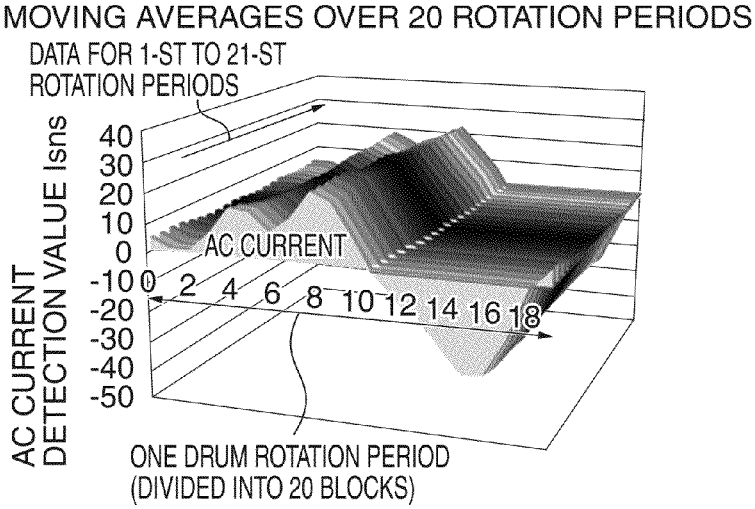

FIGS. 10A to 10C are diagrams useful in explaining moving average of averaged detection values of the developing bias AC current in the respective 20 blocks, calculated for each rotation period of the photosensitive drum 1 appearing in FIG. 2.

Referring to FIGS. 10A to 10C, the horizontal axis represents one rotation period of the photosensitive drum 1, which is divided into the above-mentioned 20 blocks. Further, the vertical axis represents detection values of the developing bias AC current, which are averaged for each of the 20 blocks.

In FIG. 10A, averaged detection values of the developing bias AC current for respective 20 blocks of each of the first to 21-st rotation periods are plotted such that the averaged detection values of the first to 21-st rotation periods are sequentially arranged from the near side to the far side.

In FIG. 10B, moving averages of averaged detection values of the developing bias AC current for the respective 20 blocks, calculated over each 10 rotation periods, are plotted such that the moving averages are sequentially arranged from the near side to the far side, starting from the oldest ones.

In FIG. 10C, moving averages of averaged detection values of the developing bias AC current for the respective 20 blocks, calculated over each 20 rotation periods, are plotted such that the moving averages are sequentially arranged from the near side to the far side, starting from the oldest ones.

As is apparent from comparison between FIGS. 10A, 10B, and 10C, by performing moving average of data detected over a plurality of rotation periods, a tendency of the detection values of the developing bias AC current becomes apparent which is caused by SD gap variation but cannot be recognized by only sampling for each one rotation period.

Based on this result, in the present embodiment, moving average is performed on the detection values (averaged detection values) of the developing bias AC current for each block using data of 20 rotation periods to thereby obtain the moving average value (IsnsM(n) (n=block number: 0 to 19) for each block. The moving average value IsnsMA(n) for each block calculated using the data of 20 rotation periods is a simple moving average value expressed by the following equation:

$$IsnsMA(n)=(Isns(n)_m+Isns(n)_m+1+\ldots+Isns(n)_m+19)/20$$

wherein

Isns(n)_m: a detection value of the developing bias current in an m-th rotation period Isns(n)_m+1: a detection value of the developing bias current in an m+1-th rotation period Isns(n)_m+19: a detection value of the developing bias current in an m+19-th rotation period n: block number of the 20-divided blocks (n: 0 to 19)

From the above, IsnsMA(n) represents the moving average value of the average values in the same block. Note that "the same block" indicates a block having the same block number.

From the moving average values of the respective 20 blocks, calculated by the above equation, a correction table is created for an output control signal that controls the developing DC bias voltage also in synchronism with the output from the drum home position sensor HP. A value Vdc(n) of the corrected developing DC bias voltage in each of the 20-divided blocks having respective block numbers of 0 to 19 is expressed by the following equation:

$$Vdc(n)=Vdc_\mathrm{ref}-\alpha\cdot IsnsMA(n)$$

wherein

Vdc_ref: developing DC bias voltage calculated in the normal density control

α: predetermined coefficient n: block number of each of the 20 divided blocks (n: 0 to 19)

Figure 11A:
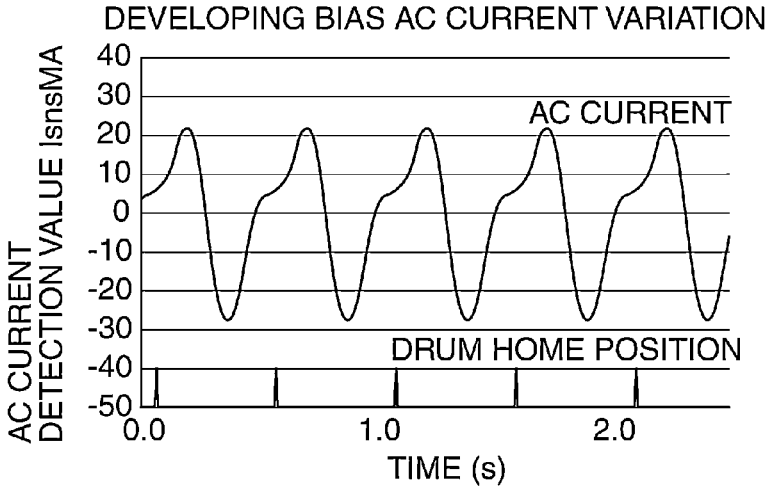
FIG. 11A is a diagram showing an example of a waveform of the developing bias AC current, obtained by moving average.

FIG. 11A is a diagram showing an example of a waveform of the developing bias AC current obtained by moving average of average values of the 20 blocks.

Figure 11B:
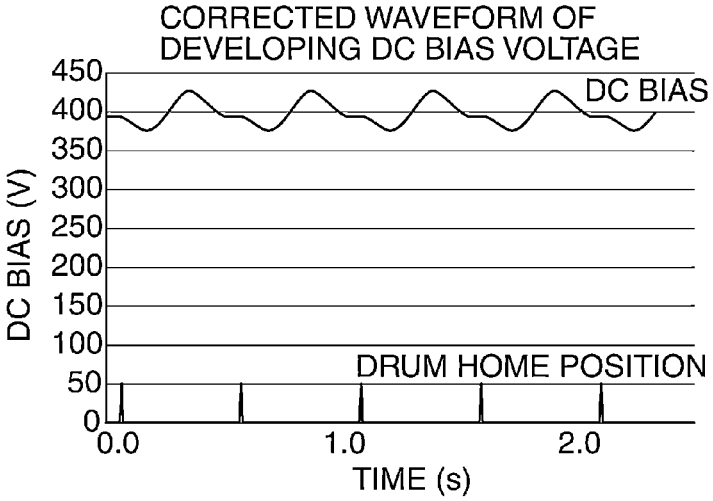
FIG. 11B is a diagram showing a waveform of the developing DC bias voltage obtained by correcting the waveform of the developing bias AC current shown in FIG. 11A.

FIG. 11B is a diagram showing a waveform of the developing DC bias voltage obtained by correcting the waveform of the developing bias AC current shown in FIG. 11A.

Figure 11C:
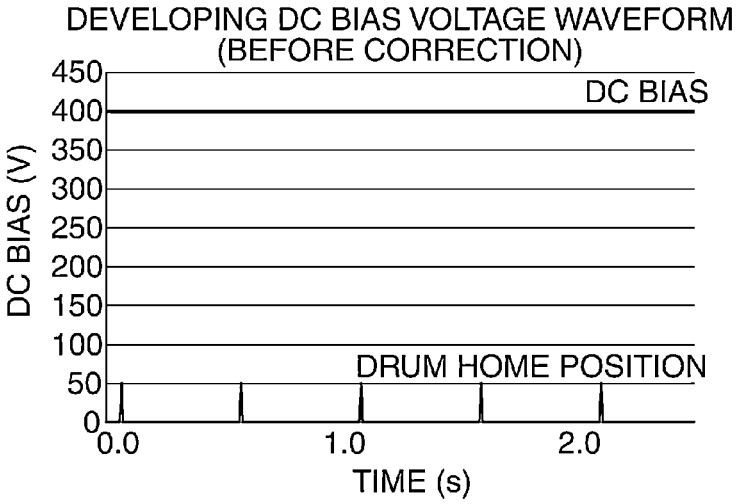
FIG. 11C is a diagram showing a waveform of the developing DC bias voltage before correction.

FIG. 11C is a diagram showing a waveform of the developing DC bias voltage Vdc_ref before correction. Note that in the present embodiment, the developing DC bias voltage Vdc_ref is set to 400V by way of example.

As shown in FIGS. 11A and 11B, the developing DC bias voltage is corrected in synchronism with the drum rotation phase such that variation thereof becomes opposite in phase to variation of the developing bias AC current before correction.

Figure 12:
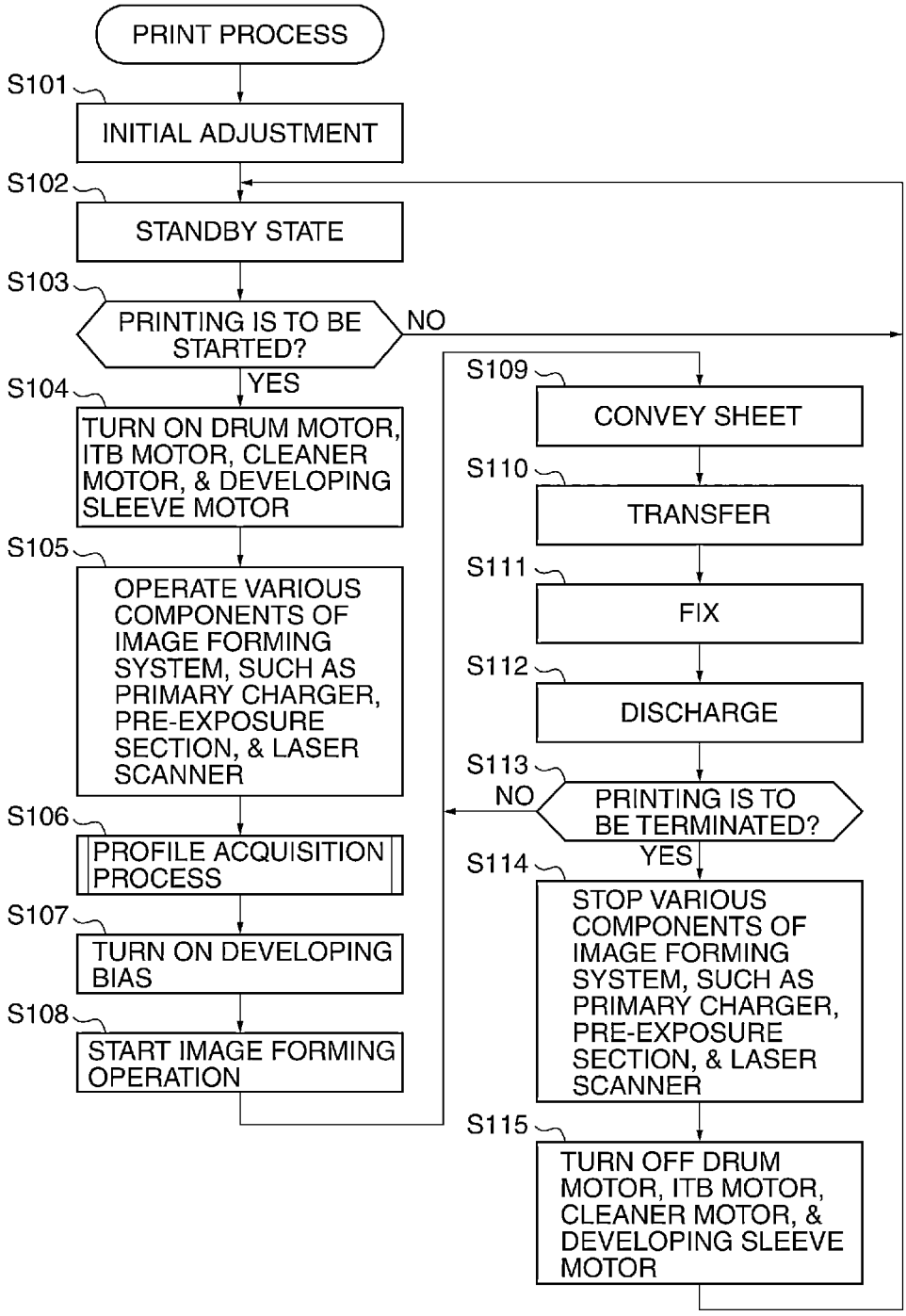
FIG. 12 is a flowchart of a print process executed by a CPU appearing in FIG. 3.

FIG. 12 is a flowchart of a print process executed by the CPU 208 appearing in FIG. 3.

Referring to FIG. 12, when the power is turned on, initial adjustment of the drive sections and the components of the image forming system is executed (step S101), and the image forming apparatus enters a standby state (step S102).

When printing is to be started (YES to a step S103), the drum motor M1, the ITB motor M8, the cleaner motor M5, and the developing sleeve motor M3 are turned on (step S104).

Then, the photosensitive drum 1, the intermediate transfer belt 8, the cleaner 5, and the developing sleeve 3*a* are driven for rotation, and the various components of the image forming system, such as the primary electrostatic charger 2, the pre-exposure section 6, and the laser scanner 7, are operated (step S105), and execute a profile acquisition process for acquiring a profile of SD gap variation, described hereinafter (step S106). In this profile acquisition process, the correction table for the developing DC bias voltage is acquired.

Then, the developing bias is turned on (step S107) to apply the developing bias between the developing sleeve 3*a* and the photosensitive drum 1. At this time, a DC component of the developing bias is output in synchronism with a detection signal from the drum home position sensor HP, according to the correction table for the developing DC bias voltage.

Then, the image forming operation is started (step S108), a sheet is conveyed in synchronism with the image forming operation (step S109), and a toner image is transferred onto the sheet at the transfer section (step S110). Then, the toner image is fixed on the sheet by the fixing section 13 (step S111), and the sheet is discharged out of the apparatus (step S112). The step S108 corresponds to the operation of an image forming unit configured to form an image using a developing bias voltage corrected using the created correction table.

Then, the CPU 208 determines whether or not printing is to be terminated (step S113). If it is determined in the step S113 that printing is not to be terminated (NO to the step S113), the CPU 208 returns to the step S109.

On the other hand, if it is determined in the step S113 that printing is to be terminated (YES to the step S113), the various components of the image forming system, such as the primary electrostatic charger 2, the pre-exposure section 6, and the laser scanner 7, are stopped (step S114).

Then, the drum motor M1, the ITB motor M8, the cleaner motor M5, and the developing sleeve motor M3 are turned off (step S115), and the image forming apparatus 300 returns to the standby state in the step S102.

Figure 13:
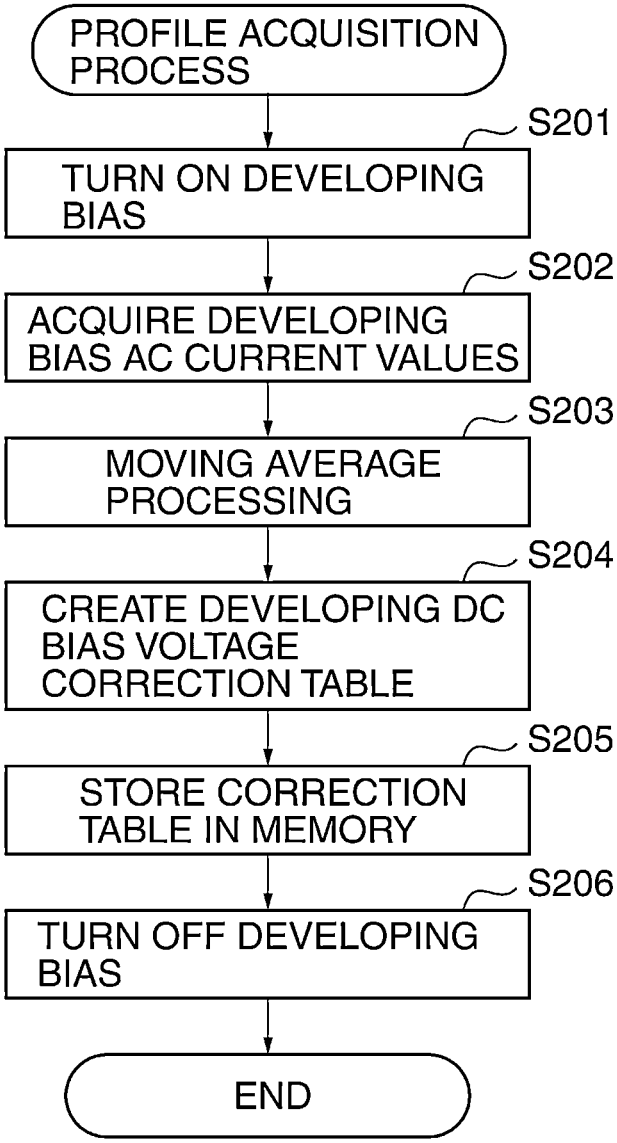
FIG. 13 is a flowchart of a profile acquisition process executed in a step in FIG. 12.

FIG. 13 is a flowchart of the profile acquisition process executed in the step S106 in FIG. 12.

Referring to FIG. 13, first, the developing bias is turned on (step S201). Then, the developing bias AC current is acquired by the CPU 208 in synchronism with the output from the drum home position sensor HP, using the AC current detection circuit 204 and the analog-to-digital converter circuit 206, appearing in FIG. 3 (step S202). The step S202 corresponds to the operation of an acquisition unit configured to acquire a current value detected by the AC current detection circuit 204 for each of the plurality of blocks in synchronism with the rotation phase detected by the drum home position sensor HP during rotation of the photosensitive drum 1 and the developing sleeve 3*a*.

Further, in the step S202, one rotation period of the photosensitive drum 1 is divided into 20 blocks of a0 to a19 with reference to the output from the drum home position sensor HP, an average value of detection values of the developing bias AC current is calculated for each block, and data of 20 rotation periods is acquired. The acquired data is stored in a memory (storage section) of the CPU 208. Therefore, the step S202 also corresponds to the operation of a storage unit configured to store an average value of the acquired current values of each block for each of a predetermined number (20 times in this example) of times of rotation, until the photosensitive drum 1 is rotated the predetermined number of times.

Further, data acquired for 20 rotation periods of the photosensitive drum 1 is read, and moving average processing is executed for each of the 20 divided blocks (step S203). The step S203 corresponds to the operation of a calculation unit configured to calculate a moving average value of ones, in each of the 20 divided blocks, of the average values stored in the storage section, after the photosensitive drum 1 is rotated the predetermined number of times.

A correction table for the developing DC bias voltage is created also in a manner synchronized with an output from the drum home position sensor HP based on the moving average value calculated for each of the 20 divided blocks by the moving average processing (step S204). The step S204 corresponds to the operation of a creation unit configured to create a correction table for correcting the developing bias voltage to be applied in each block, using the moving average value calculated for each block.

The correction table for correcting the developing DC bias voltage thus created is stored in the memory of the CPU 208 (step S205), and the developing bias is turned off (step S206), followed by terminating the present process.

Note that the created correction table may be stored in the memory of the CPU 208, a RAM or ASIC (application specific integrated circuit), which is a peripheral circuit of the CPU, or a register in a FPGA (field-programmable gate array).

Figure 14A:
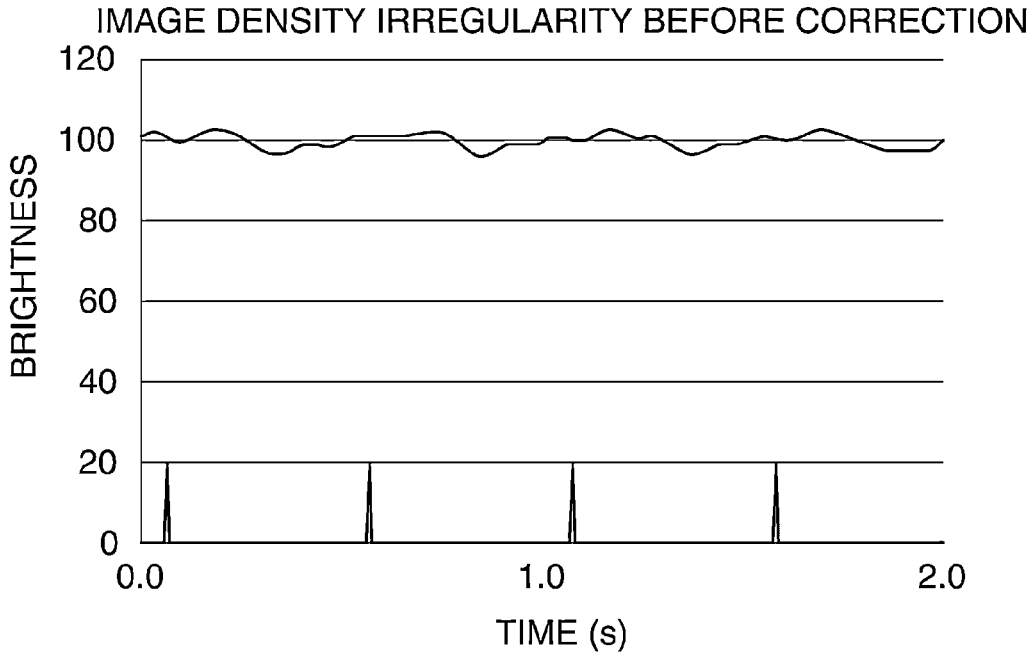
Figure 14B:
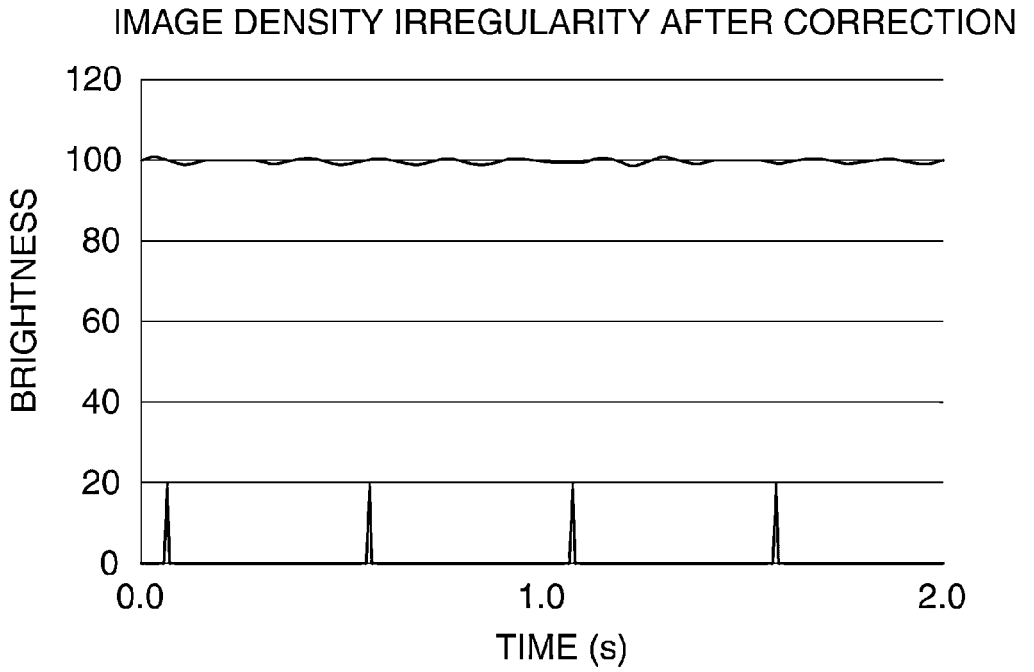

FIGS. 14A and 14B are diagrams formed by plotting values obtained by measuring brightness of an output image of entire-surface halftone having 10% of density in the sub scanning direction in synchronism with an output from the drum home position sensor HP, which show irregularity of image density. In FIGS. 14A and 14B, the horizontal axis represents time, and the vertical axis represents the brightness.

FIG. 14A shows density irregularity in a conventional state in which no correction is made, whereas FIG. 14B shows density irregularity in a state in which correction described in the present embodiment has been made.

As shown in FIG. 14B, compared with the conventional example, image density irregularity is corrected. As shown in this example, first, before the start of printing, the developing bias AC current is sampled at the drum rotation period in a state in which the developing sleeve 3*a* is stopped.

Then, during printing, the drum rotation period is divided into a plurality of blocks, and a moving average of detection values of the developing bias AC current is calculated for each block to thereby acquire a profile of SD gap variation.

Then, the developing DC bias voltage is corrected in synchronism with the drum rotation phase such that variation thereof becomes opposite in phase to variation of the developing bias AC current before correction, and the corrected developing DC bias voltage is output, whereby it is possible to reduce density irregularity caused by SD gap variation due to off-centering of the photosensitive drum 1.

Although in the present embodiment, the SD gap variation profile is acquired to create the correction table, at the start of printing, the timing of acquisition of the profile is not limited to this, but the profile may be acquired when the power is turned on, after the door of the apparatus is opened or closed, or after a predetermined number of sheets are printed.

Further, in the present embodiment, one rotation period of the photosensitive drum 1 is divided into 20 blocks, and values of the developing bias AC current are sampled over 20 rotation periods for each block to calculate a moving average value for each block, and hence it is possible to perform correction based on the sampled data of each block acquired during printing, before the developing bias voltage is applied next time for the same block.

As described above, according to the present embodiment, by dividing the current values of the current component of the developing bias AC current voltage into a plurality of blocks of each rotation period of the photosensitive drum 1, and calculating the moving average value, factors other than the rotation period of the photosensitive drum are canceled out, and only change caused by the rotation period of the photosensitive drum is extracted.

As a consequence, it is possible to feed back a correction value corresponding to the extracted amount of change to the developing bias, and hence it is possible to provide an image forming apparatus that reduces density irregularity caused by SD gap variation.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-080383 filed Apr. 8, 2013, which is hereby incorporated by reference herein in its entirety.

What is claimed is:

1. An image forming apparatus comprising:

a photosensitive drum configured to be driven for rotation;

a developing roller configured to carry toner for developing an electrostatic latent image formed on said photosensitive drum, said developing roller being disposed in a manner opposed to said photosensitive drum and driven for rotation;

an application unit configured to apply a developing bias voltage to said developing roller for forming a developing electric field between said photosensitive drum and said developing roller, to said developing roller, wherein formation of the developing electric field causing the electrostatic latent image to be developed with toner carried by said developing roller;

a current value detection unit configured to detect a current value corresponding to an electrostatic capacitance between said photosensitive drum and said developing roller;

a phase detection unit configured to detect a rotation phase of said photosensitive drum;

an acquisition unit configured to acquire current values detected by said current value detection unit for each of a plurality of blocks of a period of one rotation of said photosensitive drum in synchronism with the rotation phase detected by said phase detection unit during rotation of said photosensitive drum and said developing roller, wherein a sum of the blocks equals one complete rotation of said photosensitive drum;

a storage unit configured to store an average value of the current values acquired by said acquisition unit for each of the plurality of blocks, for each of a predetermined number of times of rotation, until said photosensitive drum is rotated the predetermined number of times;

a calculation unit configured to calculate a moving average value, in each of the plurality of blocks, of the average values stored in the storage section, after said photosensitive drum is rotated the predetermined number of times;

a creation unit configured to create a correction table for correcting the developing bias voltage to be applied by said application unit, for each of the plurality of blocks, using the moving average value for each block, calculated by said calculation unit; and an image forming unit configured to control the developing bias voltage based on the correction table created by said creation unit.

2. The image forming apparatus according to claim 1, wherein said current value detection unit detects a current value of an AC component of current caused to flow by the developing bias voltage applied by said application unit.

3. The image forming apparatus according to claim 1, wherein said application unit applies the developing bias voltage formed by superimposing an AC voltage and a DC voltage, and wherein the correction table is a table for controlling the DC voltage.

* * * * *